United States Patent [19]

Oda

[11] 4,294,305

[45] Oct. 13, 1981

[54] ROLL GAP MEASURING DEVICE FOR CONTINUOUS CASTING MACHINE

[75] Inventor: Kenichi Oda, Tokyo, Japan

[73] Assignee: Kawasaki Steel Corporation, Hyogo, Japan

[21] Appl. No.: 130,465

[22] Filed: Mar. 14, 1980

Related U.S. Application Data

[63] Continuation of Ser. No. 954,437, Oct. 25, 1978, abandoned.

[51] Int. Cl.[3] ..... B22D 11/00; B22D 2/00

[52] U.S. Cl. ..... 164/150; 164/445; 33/182; 33/DIG. 5; 72/35

[58] Field of Search ..... 164/4, 150, 154, 425, 164/426, 445, 446; 33/182, DIG. 5, 143 L, 147 K; 72/35

[56] References Cited

U.S. PATENT DOCUMENTS

| | | | |
|---|---|---|---|
| 3,882,604 | 5/1975 | Macklyn | 33/147 K |
| 3,937,271 | 2/1976 | Akiba et al. | 164/150 |
| 3,939,568 | 2/1976 | Gonos et al. | 33/143 L |
| 3,962,794 | 6/1976 | Kima et al. | 33/182 |
| 3,983,631 | 10/1976 | Dutzler | 33/143 L |
| 4,030,202 | 6/1977 | Fadl et al. | 33/143 L X |
| 4,044,580 | 8/1977 | Worden et al. | 33/182 X |

*Primary Examiner*—Robert D. Baldwin
*Assistant Examiner*—K. Y. Lin
*Attorney, Agent, or Firm*—Koda and Androlia

[57] ABSTRACT

A pair of measuring elements are installed on guide means traveling between facing rolls of a continuous casting machine, the outer end faces of said measuring elements are each formed into a circular are whose diameter is the preset value for a gap between the facing rolls. Upon entering between the facing rolls, the measuring elements are brought into contact with the rolls due to a biasing force rendered thereto, whereby the displacements of the measuring elements are measured by a transducer, thereby enabling to measure the gap between the facing rolls. In particular, since the outer end faces of the measuring elements are each formed into a circular are, the necessary gap between the facing rolls can be accurately detected.

8 Claims, 11 Drawing Figures

ROLL GAP MEASURING DEVICE FOR CONTINUOUS CASTING MACHINE

This is a continuation of application Ser. No. 954,437 filed Oct. 25, 1978, and now abandoned.

BACKGROUND OF THE INVENTION

1. Field of the Invention

The present invention relates to a roll gap measuring device for a continuous casting machine for measuring a gap between rolls within a bloom guide zone in a continuous casting foundry at an iron works.

2. Description of the Prior Art

In a continuous casting machine, a supply of molten steel is passed through a mold to be a bloom having a rectangular cross-section. While being successively passed through a bloom guide zone constituted by a plurality of rolls disposed at the predetermined gap, this red-heated bloom is cooled by the spray of water thereto, and thereafter, adapted to be drawn out of the rolls by means of pinch rolls.

In the continuous casting machine as described above, the accuracies in the arrangement of groups of rolls and the like exert a considerable influence to the quality of the bloom, and in particular, recently, there has been seen a tendency of increase in the casting speed, and hence, it has become an important problem to accurately measure the arrangement of the groups of rolls.

On the other hand, however, under the existing circumstances, in order to measure the arrangement of the rolls, the worker enters the high-temperature and highly-humid bloom guide zone to measure by means of jigs and other instruments such as a micrometer exclusively used for the purpose, and heretofore, there have been adopted measuring means highly problematical from the viewpoints of the accuracy in measurement, the length of time required and the safety factor.

SUMMARY OF THE INVENTION

In view of the above facts, one object of the present invention is to provide a roll gap measuring device for a continuous casting machine, capable of accurately measuring the gap between rolls in a short period of time.

The roll gap measuring device for the continuous casting machine according to the present invention is of such an arrangement that the outer end faces of a pair of measuring elements are each formed into a circular arc whose diameter is the preset value for a gap between the facing rolls, said measuring elements are biased in the directions opposite to each other to be brought into contact with the facing rolls, thereby enabling to measure the gap between the facing rolls accurately and in a short period of time.

Description will hereunder be given of one embodiment with reference to the drawings.

DESCRIPTION OF THE PREFERRED EMBODIMENT

Figure 1:
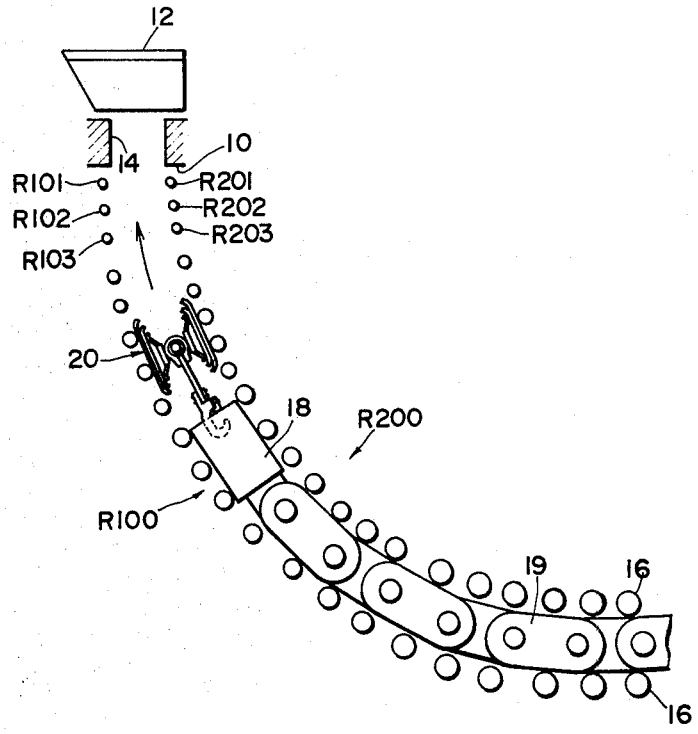
FIG. 1 is a schematic view showing one embodiment of the roll gap measuring device for the continuous casting machine according to the present invention at the time of measuring.
Figure 2:
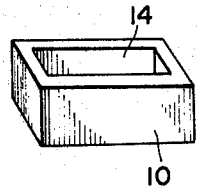
FIG. 2 is an oblique view of the mold used therewith.
Figure 3:
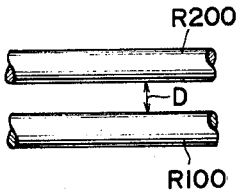
FIG. 3 is an explanatory view of the gap between the facing rolls.

Referring to FIGS. 1 and 2, denoted at 10 is a mold through which molten steel from a tundish passes. Denoted at R100 is a roll group consisting of rolls R101, R102, R103 . . . , which starts from an opening 14 of the mold 10, draws a prescribed circular arc and is progressively enlarged in diameter as shown. Disposed inside of the circular arc drawn by the roll group R100 is another roll group R200 which consists of rolls R201, R202, R203 . . . . The rolls in the roll group R200 have required gaps D meeting the thickness of the bloom from the rolls in the roll group R100, respectively (Refer to FIG. 3).

The molten steel is formed into substantially a plate-like red-heated body by the mold 10, said red-heated body, while being subjected to water spray, is cast between the roll groups R100 and R200 which are the objects to be measured, and thereafter, drawn out by means of pinch rolls 16 disposed at the ends of said roll groups so as to be formed to a desired thickness. The above operation is continuously performed so as to continuously obtain a bloom of a desired thickness.

As apparent from the above description, in this case, the rolls in the roll groups R100 and R200 are heated to high temperature as well, subjected to proper spray cooling, and the interior of the working room also becomes high in temperature and humidity.

Here, the bloom which has passed the mold 10 at the initial stage of casting work is guided by a dummy bar head 18, said dummy bar head 18 is drawn toward the pinch rolls 16 by a drawing tool 19 to thereby move the bloom toward the pinch rolls 16. However, in the case of measuring the gap between the rolls as shown in FIG. 1, a measuring devices 20 may be installed on said dummy bar head 18.

Figure 4:
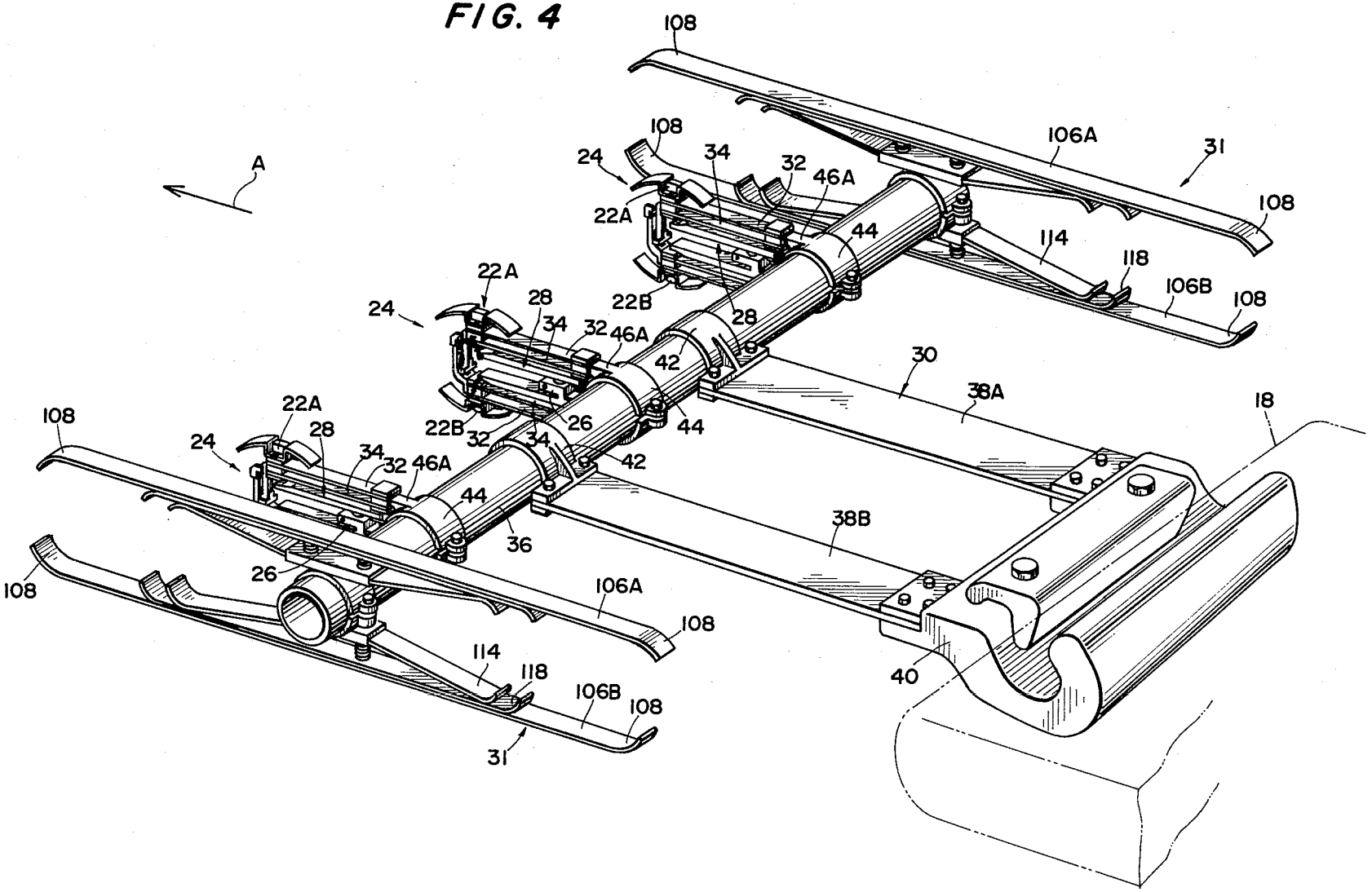
FIG. 4 is a partial, oblique view of the present embodiment.
Figure 5:
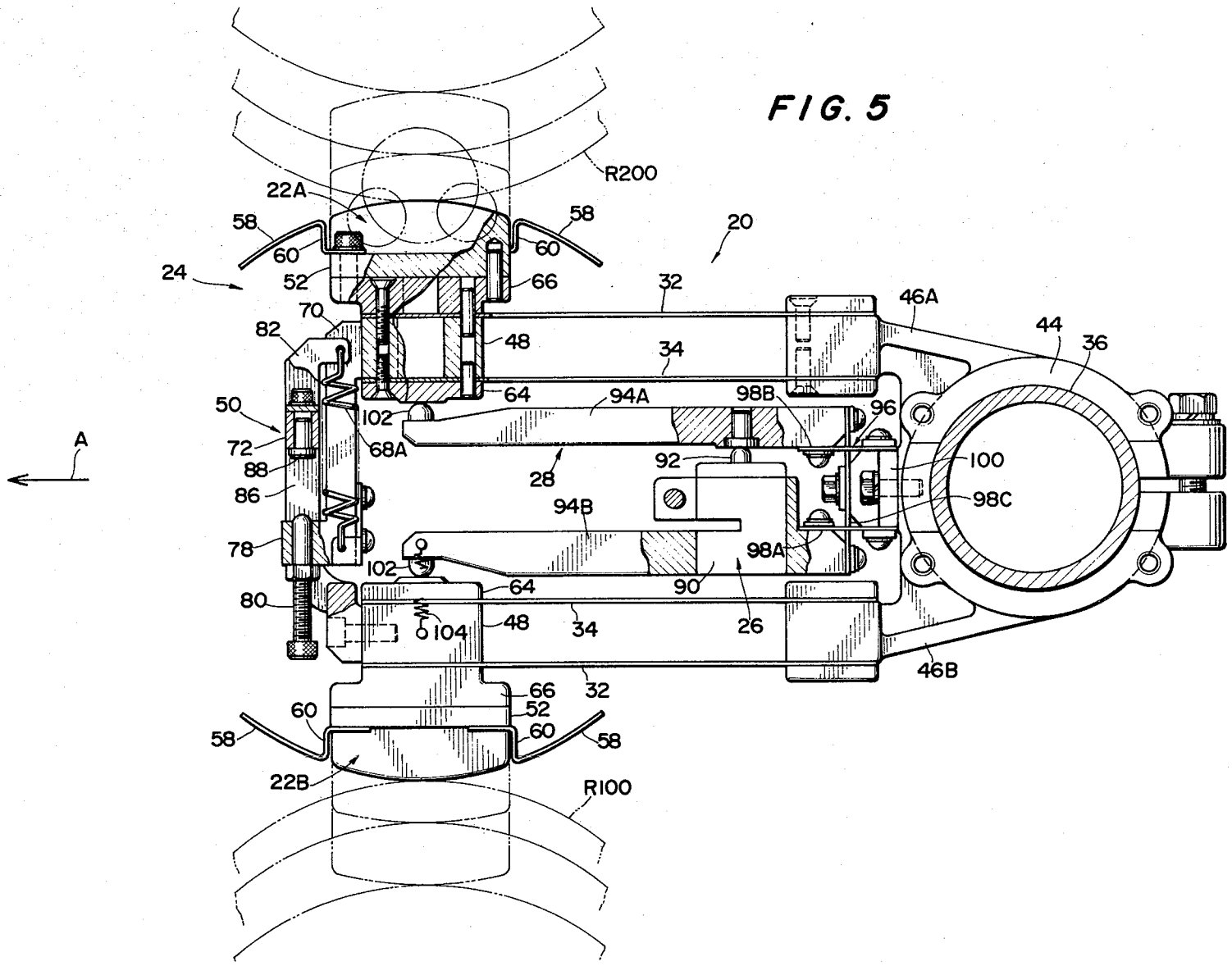
FIG. 5 is a side view with the essential portions thereof being sectioned.

As shown in FIGS. 4 and 5, said measuring devices 20 each includes measuring means 24 each provided thereon with a pair of measuring elements 22A, 22B; transducers 26 for converting the displacement values between the measuring elements 22A and 22B into electrical changes for measuring; imparting means 28 for mechanically imparting the displacements of the measuring elements to said transducer 26; connecting means 30 for inserting into and removing from the required gap D the measuring devices 20; and guide means 31.

Here, the measuring elements 22A, 22B are flexibly installed on a support shaft 36 of the measuring device 20, respectively, by means of springs 32 and 34 disposed in parallel to each other.

Firstly, description will hereunder be given of the connecting means 30 with reference to FIGS. 4 and 5. In FIG. 4, said connecting means 30 is disposed horizontally and includes: leaf springs 38A, 38B disposed in parallel to the direction of inserting the measuring means 24 which will be described hereinafter in detail (the direction indicated by an arrow A); an installing block 40 for connecting the respective ends of the leaf springs 38A and 38B to the dummy bar head 18; and a yoke 44 coupled into and secured to a support shaft 36 installed at right angle on and secured to the other ends of the leaf springs 38A, 38B via clamp metals 42. Said yoke 44 is projectingly provided thereon with arms 46A, 46B which are disposed in vertical positional relationship (Refer to FIG. 5).

Said both arms 46A, 46B are threadably coupled to the respective ends of parallel springs 32, 34 to form sets, respectively, and the other ends of the parallel springs 32, 34 are installed thereon with said measuring means 24 which is extended from the support shaft 36 in the direction indicated by the arrow A.

Figure 6:
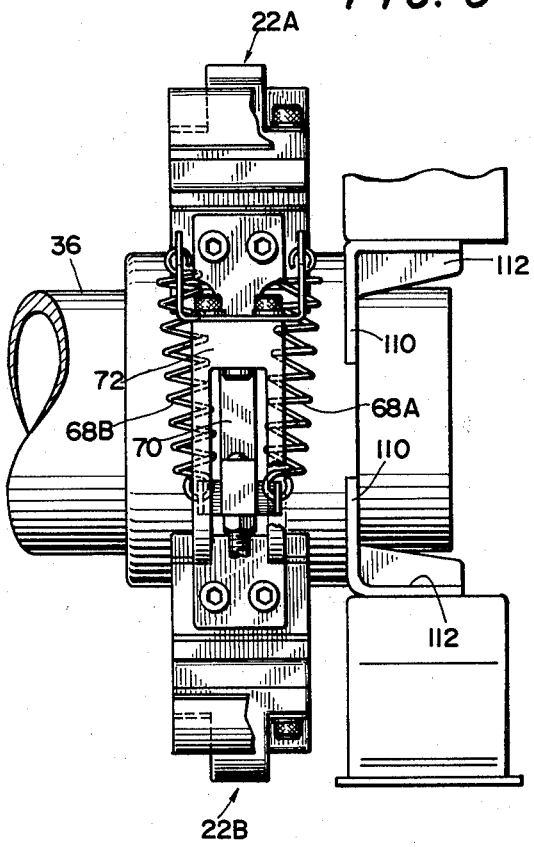
FIG. 6 is a side view of FIG. 5.

Next, description will be given of the measuring means 24 with reference to FIGS. 4 through 6. In the present embodiment, said measuring means 24 are provided at opposite ends and substantially at the center of the support shaft 36 through the parallel springs 32, 34 installed on the support shaft 36 as shown in FIG. 4 and each include two measuring elements 22A, 22B and connecting blocks 48 for installing the measuring elements 22A, 22B on the parallel springs 32, 34, respectively, as shown in FIG. 5. Biasing means 50 is provided for biasing said both measuring elements to stretch outwardly in the measuring direction (the vertical direction intersecting perpendicularly to the direction indicated by the arrow A).

Figure 8:
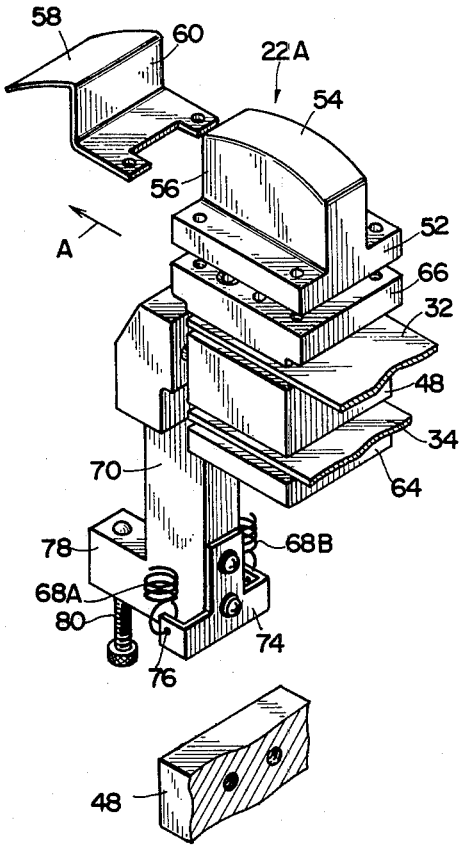
FIGS. 7 and 8 are partially broken, oblique views showing other biasing means, respectively.

In FIGS. 5 and 8, the measuring elements 22A, 22B each consist of a plank-shaped main body 52 of measuring element and a raised portion integrally projected therefrom and whose outer surface functions as the measuring surface 54 which is formed into a spherical surface having a diameter substantially equaling to the specified gap D. Both measuring elements 22A, 22B are disposed in vertical positional relationship with each other in the direction of measuring, with the measuring surfaces 54 thereof facing outwardly (Refer to FIG. 5). Further, in FIGS. 5 and 8, side plates 60 each made of an elastic plate and bendingly provided at one end thereof with a curved wing 58 having substantially the same spherical surface as the measuring surface 54 are connected through screws to the main body 52 of the measuring element in such a manner that the curved wings 58 are connected to and flush with the opposite sides of the measuring surface 54.

Next, description will be given of the connecting block 48. In FIG. 8, the connecting block 48 has an inner keep plate 64 clamping a leaf spring 34 and an outer keep plate 66 clamping another leaf spring 32, all five of the outer keep plate 66, leaf spring 34, connecting block 48, leaf spring 32 and inner keep plate 64 are integrally threadably coupled to one another to be formed into a block, the main body 52 of the measuring element is threadably coupled onto the outer keep plate 66. Thus, the measuring elements 22A, 22B are vertically displaceably installed on the installing yoke 44, i.e. on the support shaft 36 through the respective leaf springs 32, 34 with the respective measuring surfaces 54 facing outwardly.

Figure 7:
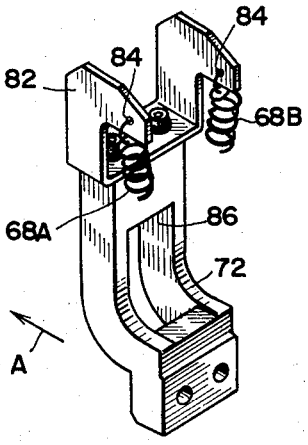

Another biasing means 50 shown in FIGS. 5 through 8 includes biasing coil springs 68A, 68B disposed in parallel to each other in a substantially vertical direction and upper and lower levers 70, 72 each engaged at one end with said respective coil spring 68A or 68B (Refer to FIGS. 7 and 8). The upper lever 70 is threadably coupled at the upper end thereof to the front face of the connecting block 48 (Refer to FIGS. 5 and 8) and whose lower end is threadably coupled to an engageable plate 71 disposed in a lateral direction intersecting perpendicularly to the direction indicated by the arrow A. Engageable holes 76, 76 at opposite ends of said engageable plate 74 are engaged with the lower ends of said springs 68A, 68B (Refer to FIG. 8). Said upper lever 70 is bendingly provided thereon with a bent portion 78 extending from the lower end thereof in the direction indicated by the arrow A, and an adjusting screw 80 vertically penetrates said bent portion 78.

In FIG. 7, the lower lever 72 is threadably coupled at the lower end thereof to the front face of the connecting block 48 at the lower portion (Refer to FIG. 5). Threadably coupled to the curved extension of the lower lever 72 is an engageable plate 82 having bifurcated upper ends. The upper ends of said springs 68A, 68B are respectively engaged with engageable holes 84, 84 provided at the forward ends of said engageable plate 82 bent toward in the direction opposite to the arrow A in a manner to clamp said lever 70 (Refer to FIG. 5). Additionally, the lever 72 is penetratingly provided therein with a window 86 in the direction indicated by the arrow A, and a stopper 88 to be projected downwardly is provided in said window 86 (Refer to FIG. 5).

In FIG. 5, said other biasing means 50 is disposed in the forward portion of the measuring means 24, the bent portion 78 of the lever 70 is located within the window 86, the inner end of the adjusting screw 80 is disposed in vertically opposed relationship with the stopper 88, and the springs 68A, 68B are arranged such that the upper and lower measuring elements 22A, 22B are constantly separated from each other through the levers 70, 72 in the vertical direction of measuring.

Next, description will be given of the transducer 26 with reference to FIG. 5. Said transducer 26 includes a cylindrical main body 90 of the transducer and an armature 92 biased within the main body 90 and coaxially movable therewith (not shown in detail), said transducer 26 is interposed between the pairs of springs 32, 34, further, said main body 90 is installed on a lever arm 94B out of two upper and lower arms 94A, 94B disposed in parallel to the direction indicated by the arrow A inside of the pairs of leaf springs 32, 34, and the upper end of the armature 92 is adapted to be biased to constantly abut against an intermediate portion of the upper arm 94A so that the displacement between the facing rolls can be measured in a reduced proportion.

In FIG. 5, a cross spring 96 consists of three leaf springs disposed perpendicular to one another but not really intersecting one another.

And, the leaf springs 98A, 98B connect the respective ends of the arms 94A, 94B to the mounting fixture 100 installed on the yoke 44, and the central portion of the leaf spring 98C is threadably coupled to the mounting fixture 100, and the opposite ends of the leaf spring 98C are threadably coupled to the respective ends of the arms 94A, 94B.

Both arms 94A, 94B are each installed at one end thereof with a steel ball 102 and with one end of a biasing coil spring 104 (Refer to FIG. 5), the other end of which is installed on the connecting block 48 to constitute imparting means 28. Additionally, the arms 94A, 94B are arranged such that the respective ends are supported by the cross spring 96 and the other ends are biased to constantly resiliently abut against the inner keep plates 64 so that the displacement between the measuring elements can be measured in a reduced proportion and mechanically imparted to the armature 92.

Figure 9:
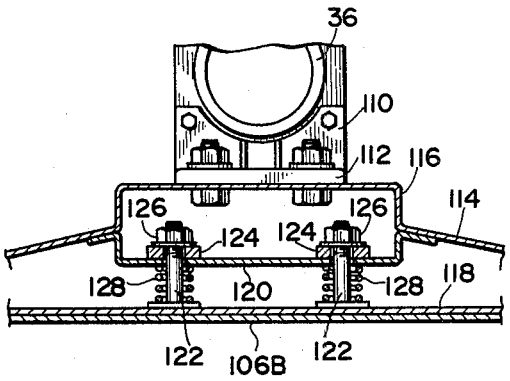
FIG. 9 is an enlarged side view showing part of FIG. 4.

In FIGS. 4 and 9, the guide means 31 consists of a pair of facing skid plates 106A, 106B which are disposed in the direction indicated by the arrow A, and the opposite ends of which each have a curved portion 108 curved inwardly. Said guide means 31 thus arranged are installed on the opposite ends of the support shaft 36, respectively, as shown.

To further detailedly describe this, in FIGS. 4 and 9, mounting plates 110 having letter 'L' shaped cross-section are threadably coupled to the end face of the yoke 44, threadably coupled to bent portions 112 thereof outwardly projecting are bent portions 116 made of a small size spring leaves 114 and opening downwardly, and opposite ends of said spring leaves 114 are in resiliently, slidingly abutting contact with the inner surfaces of medium size spring leaves 118 which are overlappingly installed on the inner surfaces of the skid plates 106A, 106B respectively, (Refer to FIG. 4). On the other hand, integrally installed on the bent portion 116 of said small size spring leaf 114 is a lower support leaf spring 120 bent to open upwardly corresponding to the bent portion of the small size spring leaf 114, and the lower support leaf spring 120 is vertically movably installed on the medium size leaf spring 118 through bolts 122 whose respective ends are fixed on the medium size leaf spring 118. Denoted at 124 is a welded ring interposed between a nut 126 and the lower support leaf spring 120, 128 is a coil spring wound around a bolt 122 between the lower support leaf spring 120 and the medium size leaf spring 120 and biased to separate the lower support leaf spring 120 from the medium size leaf spring 118.

And, the small size spring leaves 114 and the skid plates 106A, 106B are in resilient contact with each other through the medium size leaf springs 118.

Next, description will be given of action of the present invention. In FIGS. 1 and 4, if the installing block 40 is connected to the dummy bar head 18 in the direction of extending the dummy bar and the device according to the present invention is inserted between the rolls R100 and R200, then the measuring elements 22A, 22B are protected and guided by the guide means 31. At this time, the skid plates 106A, 106B are stretched across a plurality of pairs of rolls and stretched outwardly, the measuring means 24 are stretched across by the aforesaid other biasing means 50 and stretched across the pair of facing rolls R100 and R200 in the direction of measuring, the measuring surfaces 54 of the measuring elements 22A, 22B abut against the rolls, and in association with the above operations, the transducer 26 is operated through the arms 94A, 94B, so that signals meeting therewith can be emitted to the outside.

Said signal is compared with the reference signal relating to the predetermined gap between the rolls R100 and R200 so as to find the error of the gap D. There is such a feature that the less the error of the gap D is, the more accurate the value of gap can be found.

Additionally, if the device according to the present invention is inserted by the dummy bar in the direction indicated by the arrow A or drawn out, then the device is smoothly guided by forward and rearward curved portions 108 of the skid plates, and the measuring elements are also smoothly guided by the side plates 60, so that the roll gaps at desired positions can be successively measured.

As described above, the measurement of the roll gaps is completed in such a manner that the guide means 24 measures the uppermost portions of the first and second roll groups R100 and R200, i.e. the gap between the rolls R101 and R201 that are disposed closest to the mold 10. Then, clamp metals 42 are removed so as to disengage the installing block 40 from the dummy bar head 18 and the roll gap measuring device 20 is upwardly drawn out through the mold 10. Thus, the respective roll gaps are properly maintained and the continuous casting work can be immediately started by use of the dummy bar head 18 located adjacent to the mold.

Figure 10:
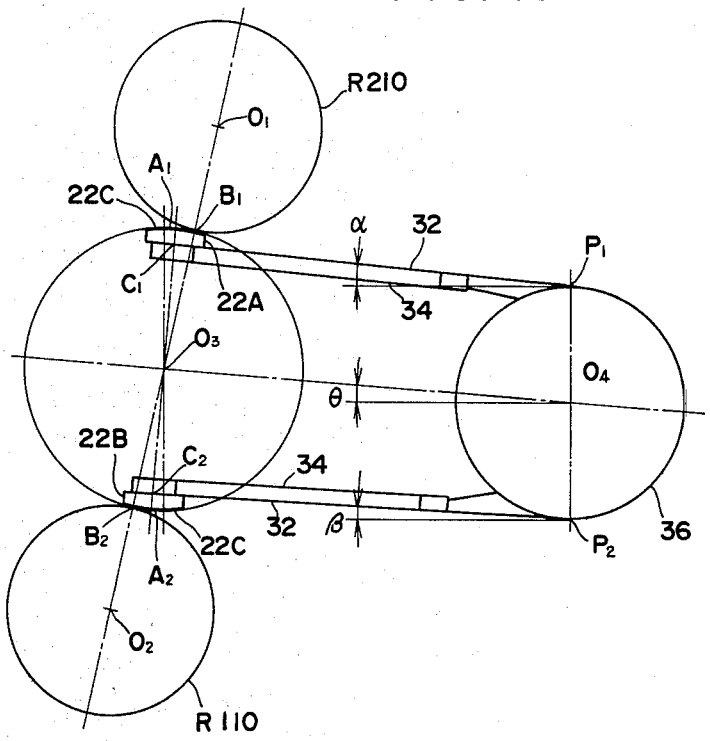
FIG. 10 is an explanatory view of the state of measuring.

Next, more detailed description will be given of the measuring of roll gaps by use of said roll gap measuring device 20. FIG. 10 shows the condition where the measuring elements 22A, 22B are in contact with a roll R110 out of the first roll group R100 and another roll R210 out of the second roll group R200 and corresponding to the roll R110.

Assumption is made that points of the parallel springs 32, 34 secured to the support shaft 36 are $P_1$ and $P_2$, intermediate points of the circular arcs at the outer ends 22C of the measuring elements are $A_1$ and $A_2$, the axis of the roll R210 is $O_1$, a point of contact between the roll 210 and the measuring element 22A is $B_1$, the axis of the roll R110 is $O_2$, a point of contact between the roll R110 and the measuring element 22B is $B_2$, the center of circles drawn by the outer ends 22C of the measuring elements 22A, 22B is $O_3$, and intersecting points of the extensions of the parallel springs 32, 34 with a straight line connecting $A_1$ to $A_2$ are $C_1$ and $C_2$.

Additionally, if it is assumed that an intermediate point between $P_1$ and $P_2$ is $O_4$, angles that are made by the parallel springs 32, 34 with a horizontal plane are $\alpha$ and $\beta$, and the center line $\overline{O_3 O_4}$ of the detecting head with a horizontal plane is O, then $\overline{C_1 O_3}=\overline{C_2 O_3}$, $\overline{A_1 O_3}=\overline{A_2 O_3}=\overline{B_1 O_3}=\overline{B_2 O_3}$.

Hence, in the case $O_3$ is located on $\overline{O_1 O_2}$, even if $\overline{A_1 A_2}$ does not coincide with $\overline{O_1 O_2}$, the roll gap can be determined by measuring the roll gap at a position where $O_3$ is located on $\overline{O_1 O_2}$, i.e. at the position where the measuring elements 22A, 22B come closest to each other, when the measuring elements 22A, 22B travel between the rolls R110 and R210 from right to left in the drawing.

Figure 11:
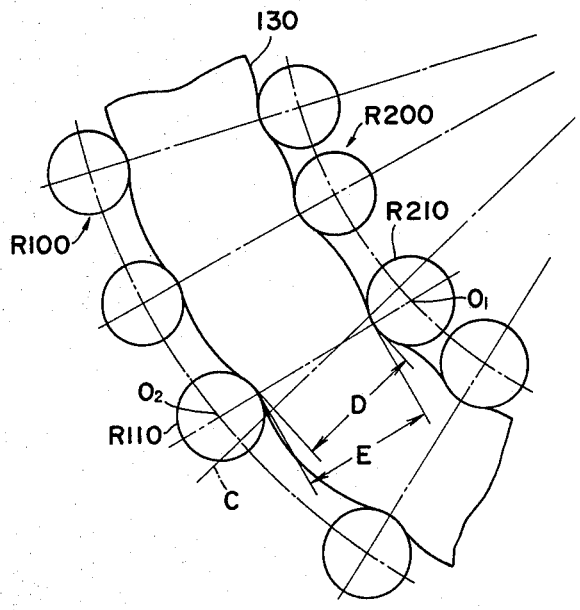
FIG. 11 is a schematic view showing the shifting of the rolls.

The measuring method as described above is particularly effective in the case the rolls R110 and R210 are out of the regular positions (on the straight line C in the drawing) located on an extension of the radius of curvature of the roll groups as shown in FIG. 11. With the conventional measuring devices in general, only the dimension D may be measured; whereas, with the present measuring device, the dimension E is measurable.

In the practical continuous casting condition, the bloom 130 is bulging between the rolls as shown in FIG. 11, and the bulging increases in quantities with the increase in roll pitch. Hence, in the case the axes of rolls are shifted, the same result is obtained as the roll gap is stretched outwardly. In particular, the effect of bulging on the bloom results in lowered quality of the product. Therefore, the device which can detect the shifting of the roll pitch as an unusual roll gap is regarded as excellent, and in this respect too, the excellent of the measuring device according to the present invention is understandable.

Additionally, the results of measurement in the above description can be emitted to outside by use of a wireless unit not shown.

Furthermore, according to the present invention, even under high temperature and high humidity, the operation by use of the dummy bar makes it easy to measure, further, the adoption of the hinge action by means of a cross spring without using a usual bearing results in an advantage of minimizing the possibilities of failure due to high temperature which differs from the use of other bearings, and the measuring elements are so arranged as to be supported by pairs of parallel springs, so that, even if there is a variation within a certain range of value, the measuring elements can move parallelly as indicated by two-dotted chain lines in FIG. 5 without being inclined. Further, the measuring device according to the present invention comes into contact with the rolls through the skid plates, and are connected to the dummy bar head through the springs, so that impacts and vibrations at the time of the movement can be absorbed, thereby enabling to accurately measure.

What is claimed is:

1. A roll gap measuring device for continuous casting machines wherein said measuring device comprises:

guide means travelling between facing rolls of the continuous casting machine, said guide means comprising a pair of opposing skids and leaf springs coupled to said skids biasing said skids in contact with facing rolls;

at least one leaf coupling said guide means to a dummy bar head;

a pair of measuring elements supported by said guide means relatively movable and both of which having outer end surfaces each formed into a circular arc, the distance between the central points of outer end surfaces of each pair of measuring elements is a preset value approximately equal to a gap between the facing rolls;

biasing means for biasing said measuring element in the direction separating from each other so as to bring them into contact with the outer peripheries of separate rolls, respectively; and a transducer for measuring the displacement of said measuring elements, whereby said roll gap measuring device, travelling between said rolls, measures the gaps.

2. A roll gap measuring device for a continuous casting machine as set forth in claim 1, characterized in that said measuring elements are installed on a support shaft disposed in parallel to the rolls.

3. A roll gap measuring device for a continuous casting machine as set forth in claim 2, characterized in that said pair of measuring elements are installed on the support shaft through the parallel springs, thereby enabling to substantially rectilinearly displace said pair of measuring elements.

4. A roll gap measuring device for a continuous casting machine as set forth in claim 1, characterized in that the outer end faces of said measuring elements are formed into spherical surfaces.

5. A roll gap measuring device for a continuous casting machine as set forth in claim 2, characterized in that the displacements of said measuring elements are imparted to a transducer through the imparting means each constituted by a lever.

6. A roll gap measuring device for a continuous casting machine as set forth in claim 5, characterized in that said lever is installed on the support shaft through a cross spring.

7. A roll gap measuring device for a continuous casting machine as set forth in claim 2, characterized in that a plurality of said measuring elements are installed on the support shaft in the axial direction thereof.

8. A roll gap measuring device for continuous casting which includes opposing rollers, said measuring device comprising:

an installing block for providing a coupling to a dummy bar head;

a support shaft;

a pair of flat springs coupling said installing block to said support shaft;

at least two opposing first pairs of leaf springs provided one pair on each end of said support shaft;

a skid coupled to each of said leaf springs of said first pairs of leaf springs for engaging with said rollers;

at least one yoke coupled to said support shaft;

a pair of opposing leaf springs coupled to said yoke;

a measuring element slidably disposed at each of said second pair of opposing leaf springs such that said measuring element move rectilinearly and perpendicular to said second pair of opposing leaf springs, each of said measuring elements having an arcuate measuring surface, the distance between the central points of outer end surface of the measuring elements is approximately equal to the gap between said opposing rollers;

a third pair of leaf springs coupled to said yoke provided within said second pair of leaf springs, each of said third pair of leaf springs engaging with and being moved by one of said elements; and a transducer provided between and engaging with said third pair of leaf springs whereby when said third pair of leaf springs is caused to move by said measuring element said transducer transmits a signal indicative of the gap between said opposing rollers.

* * * * *